US010875556B2

(12) United States Patent
Pereira

(10) Patent No.: US 10,875,556 B2
(45) Date of Patent: Dec. 29, 2020

(54) SUPPORT FRAME FOR A TEMPORARY SIGNAL FOR A RAILROAD

(71) Applicant: Technological Resources Pty. Limited, Melbourne (AU)

(72) Inventor: Tiberio Virgilio Nogueira Pereira, Kardinya (AU)

(73) Assignee: Technological Resources Pty. Limited, Melbourne (AU)

( * ) Notice: Subject to any disclaimer, the term of this patent is extended or adjusted under 35 U.S.C. 154(b) by 489 days.

(21) Appl. No.: 15/738,763

(22) PCT Filed: Jun. 23, 2016

(86) PCT No.: PCT/AU2016/050531
§ 371 (c)(1),
(2) Date: Dec. 21, 2017

(87) PCT Pub. No.: WO2016/205882
PCT Pub. Date: Dec. 29, 2016

(65) Prior Publication Data

US 2018/0194377 A1 Jul. 12, 2018

(30) Foreign Application Priority Data

Jun. 25, 2015 (AU) ..... 2015902468

(51) Int. Cl.
*B61L 5/18* (2006.01)
*B61L 5/12* (2006.01)

(52) U.S. Cl.
CPC ..... *B61L 5/1872* (2013.01); *B61L 5/12* (2013.01); *B61L 5/1827* (2013.01); *B61L 5/1863* (2013.01)

(58) Field of Classification Search
CPC ..... B61L 5/1872; B61L 5/12; B61L 5/1827; B61L 5/1863
See application file for complete search history.

(56) References Cited

U.S. PATENT DOCUMENTS 237,136 A * 2/1881 Shepard et al. ..... B61L 25/021 246/108
352,412 A * 11/1886 James ..... B61L 25/021 246/108
360,056 A * 3/1887 Simpson et al. ..... B61L 25/021 246/108
418,155 A 12/1889 Berry
440,890 A 11/1890 Coolbaugh
605,847 A 6/1898 Biddinger
(Continued)

OTHER PUBLICATIONS

Aug. 11, 2015—International-Type Search Report and Written Opinion of AU2015902468.
(Continued)

*Primary Examiner* — Nimeshkumar D Patel
*Assistant Examiner* — Tania Courson
(74) *Attorney, Agent, or Firm* — Banner & Witcoff, Ltd.

(57) ABSTRACT

A support frame is disclosed for a temporary signal for a railroad. The railroad includes a track having two elongate rails, and the support frame comprises a post arranged to support a railroad signal, a base joined to the post, and at least one attachment for attaching the base to both rails of the track. The base comprises a first beam and a second beam, and the first beam and the second beam are each arranged to be attached to both of the rails.

18 Claims, 2 Drawing Sheets

(56) References Cited

U.S. PATENT DOCUMENTS

| | | | | | |
|---|---|---|---|---|---|
| 606,197 | A | | 6/1898 | Dunn | |
| 822,195 | A | * | 5/1906 | Eaton | B61L 5/125 246/477 |
| 853,489 | A | * | 5/1907 | Wendt | B61L 25/021 246/108 |
| 1,158,610 | A | * | 11/1915 | Whitman | B61L 29/24 116/63 R |
| 1,271,740 | A | * | 7/1918 | McKinney | G08G 1/096716 116/63 R |
| 1,301,914 | A | | 4/1919 | Currie | |
| 1,435,807 | A | | 11/1922 | Conly | |
| 1,458,808 | A | | 6/1923 | Conley | |
| 1,747,278 | A | | 2/1930 | Zawyruchia | |
| 2,109,286 | A | * | 2/1938 | Cubby | E01F 13/06 49/13 |
| 2,520,866 | A | * | 8/1950 | Wells | B61L 5/1863 356/123 |
| 3,806,172 | A | * | 4/1974 | Maze | E05C 19/00 292/44 |
| 3,952,978 | A | * | 4/1976 | Reinitz | B61L 5/1872 246/477 |
| 5,038,704 | A | * | 8/1991 | Dean | B61L 23/06 116/173 |
| 5,097,790 | A | * | 3/1992 | Massey | E01F 13/06 116/303 |
| 5,905,216 | A | | 5/1999 | Davis | |
| 6,386,492 | B1 | | 5/2002 | Brown et al. | |
| 7,032,865 | B2 | * | 4/2006 | Lafreniere | B61L 5/14 246/473 R |
| 2018/0143017 | A1 | * | 5/2018 | Choi | B61D 15/08 |
| 2018/0201283 | A1 | * | 7/2018 | Schalk | B61L 9/00 |

OTHER PUBLICATIONS

Aug. 24, 2016—International Search Report and Written Opinion of PCT/AU2016/050531.

* cited by examiner

SUPPORT FRAME FOR A TEMPORARY SIGNAL FOR A RAILROAD

CROSS-REFERENCE TO RELATED APPLICATIONS

The present application is a U.S. National Phase filing of International Application No. PCT/AU2016/050531, filed on Jun. 23, 2016, and claiming priority to Australian Patent Application No. 2015902468 filed Jun. 25, 2015. The present application claims priority to and the benefit of all the above-identified applications, which are all incorporated by reference herein in their entireties.

FIELD OF INVENTION

The present invention relates to a support frame for a temporary signal for a railroad.

BACKGROUND OF THE INVENTION

A railroad signal is a mechanical or an electrical sign erected beside a railroad track to convey information to a train driver relating to the state of the railroad ahead. The information that is conveyed typically relates to one or more of the following: that the line ahead is clear or blocked; that permission to proceed is given; the permissible speed of travel; the direction that track points (also known as switches) are set; and the state of signals ahead. This list is non-exhaustive and it is envisioned that other types of information can also be conveyed.

In order to ensure that a train driver is provided with an adequate frequency of information, a number of signals are discretely positioned along the length of a railroad track. At important locations where changes in train movement can be expected, e.g. near to a train station or at a track point, the signals may be located more closely together. Conversely, when travelling along uninterrupted sections of track, the signals may be more sparse.

Occasionally it may occur that a signal becomes damaged, such as through inclement weather, as a result of accident or simply through wear, and it is not always possible to quickly repair the signal. Alternatively, when new railroad track is being built, the construction of new signals may be delayed while the requisite construction permits and ground disturbance authorisations are obtained. The missing signal can result in danger to a train due to the train being operated incorrectly, such as the train travelling at a speed which will not permit it to stop before reaching an obstacle, e.g. the end of the railroad track.

In order to overcome these problems, many types of temporary signals have been developed, which can be quickly and easily erected alongside a railroad track. Because temporary signals need to be easily transportable and do not normally need to remain in an operative position for lengthy periods, the temporary signals tend to have weaker frames supporting the signal. Accordingly the temporary signals can themselves become easily damaged and non-functional.

The applicant is aware of various types of prior art temporary signals, which primarily have a frame joined to a single rail of a railroad track by opposed curved clamps that engage onto opposite lower flanges of the rail. A problem with such single rail attachment mechanisms is that they may become loose due to vibrations caused by passing trains. Also, in windy conditions, the wind buffeting against the signal can cause movement in the frame and consequently also lead to loosening of the attachment mechanisms. This may result in the frame falling down or being displaced so that the temporary signal is moved away from its optimal operative position.

The above described background art is not intended to limit the application of the retaining system as disclosed herein.

SUMMARY OF THE INVENTION

According to a first aspect of the present invention, there is provided a support frame for a temporary signal for a railroad, wherein the railroad includes a track having two elongate rails, the support frame comprising:

a post arranged to support a railroad signal;

a base joined to the post; and at least one attachment for attaching the base to both rails of the track;

wherein the base comprises a first beam and a second beam; and wherein both the first beam and the second beam are arranged to be attached to both of the rails.

The base may be arranged to be attached to each of the rails at at least two discrete spaced apart locations.

The post may comprise a fixed arm and a movable arm, and wherein the fixed arm is fixedly joined to the base and the movable arm is pivotally joined to the fixed arm at a pivot.

The post may comprise a connecting bolt for securing the movable arm to the fixed arm to thereby prevent pivoting of the movable arm.

The fixed arm may comprise a fixed end joined to the base and an opposed terminal end, and wherein the pivot is provided at or near to the terminal end.

The movable arm may comprise a distal end for receiving the signal and an opposed proximal end, and wherein the pivot is provided substantially centrally along a length of the movable arm between the distal end and the proximal end.

The proximal end of the movable arm may be securable to the fixed arm, thereby to prevent pivoting of the movable arm around the pivot.

The at least one attachment may comprise at least two clamps.

The support frame may comprise at least one foot joined to the base, wherein each foot is positioned so as to be remote from the track during use.

At least one foot may be located so as to be substantially longitudinally aligned with and beneath the post.

In a support frame having multiple feet, the feet may be aligned so as to be coplanar with a pivoting plane of the post.

Each foot may be extendable or telescopic.

Each of the feet may comprise be a scaffolding foot.

According to a second aspect of the present invention, there is provided a temporary signal comprising a support frame according to the first aspect and a railroad signal supported by the post.

According to a third aspect of the present invention, there is provided a method of securing a support frame to a railroad for providing a temporary signal for the railroad, wherein the railroad includes a track having two elongate rails, the method comprising the steps of:

providing a post arranged to support a railroad signal, wherein the post is joined to a base; and attaching the base to both rails of the railroad track.

The method may comprise the step of attaching the base to each of the rails at at least two discrete spaced apart locations.

The method may comprise the step of pivoting the post between a collapsed position intended for use during transportation or storage, and an erected position intended for operative use.

The method may comprise the step of supporting a cantilevered end of the base by one or more feet.

BRIEF DESCRIPTION OF THE DRAWINGS

The present invention will now be described, by way of example, with reference to the accompanying schematic drawings, in which.

DESCRIPTION OF AN EMBODIMENT OF THE INVENTION

Figure 1:
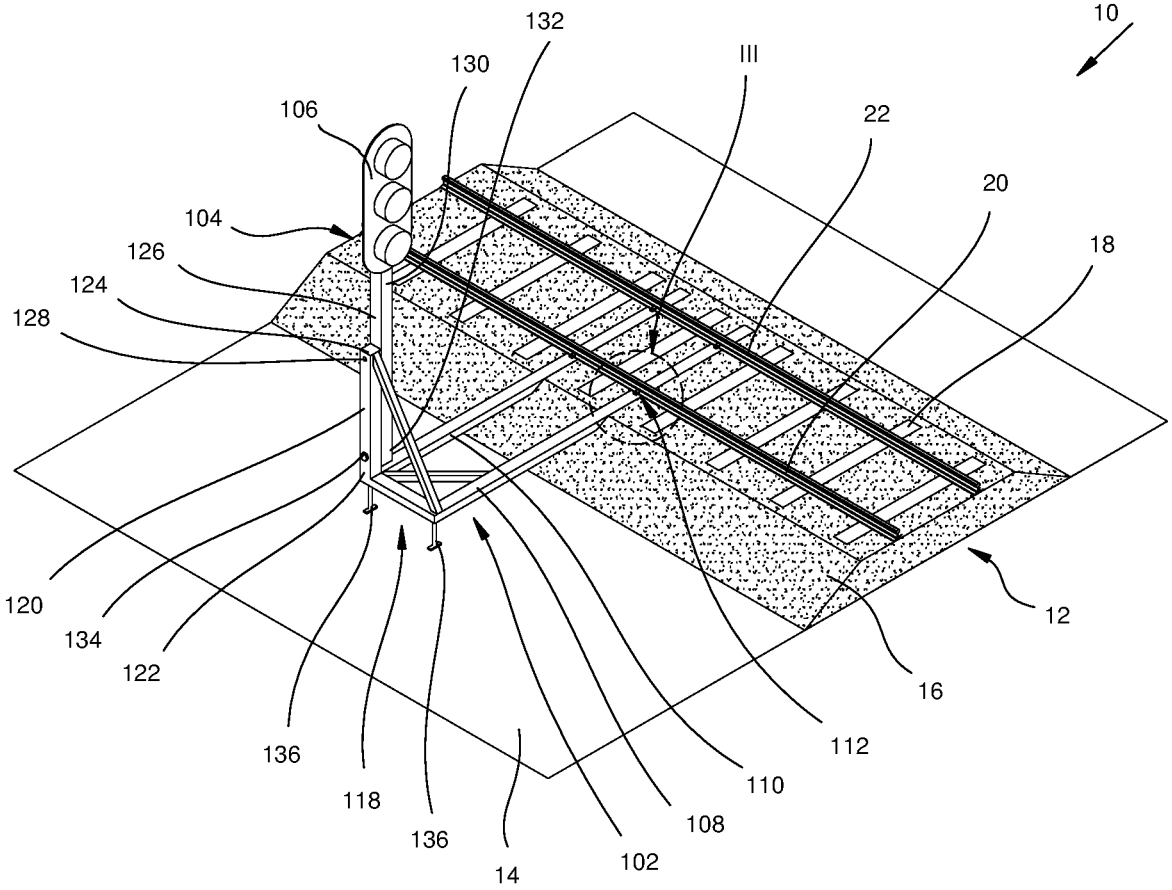
FIG. 1 is a perspective view of a support frame for a temporary signal for a railroad according to an embodiment of the invention, the support frame being shown in situ joined to a railroad track.

Referring to the drawings, there is shown a support frame for a railroad signal in accordance with an embodiment of the invention, being generally indicated by reference numeral 10. The support frame 10 is arranged to be removably attached to a railroad 12.

Conventionally, the railroad 12 traverses a ground surface 14 and is formed on a track bed that comprises a rocky ballast 16 that serves to raise the railroad 12 above the ground surface 14. Typically the track bed is about 30-46 cm above the ground surface 14. The ballast 16 supports a number of sleepers 18 that are transversely orientated relative to the direction of the railroad 12. Normally the sleepers 18 are orientated to extend substantially perpendicularly across to the railroad 12. The sleepers 18 support a pair of elongated rails 20, 22 that are secured to the sleepers 18 by tie plates (not shown). The rails 20, 22 are spaced apart according to the desired gage of the railroad.

Figure 3:
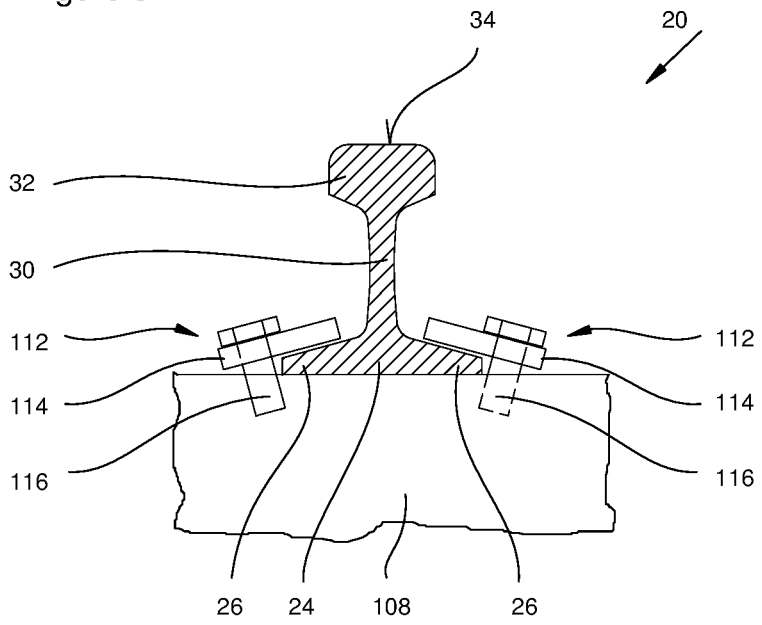
FIG. 3 is an enlarged end view of a portion of the support frame indicated by arrow III in FIG. 1.

As is more clearly shown in FIG. 3, a rail 20 includes a rail base 24 having opposed lower flanges 26 projecting from opposite sides of a rail web 30. Tie plates (not shown) are attached to the lower flanges 26 to secure the rail 20 to the sleepers 18. The rail web 30 extends upwardly from the rail base 24 and supports a rail head 32, the upper part of which forms a running surface 34 for engaging the wheels of a train. It is well understood that the rail 22 is substantially identical to the rail 20 and has similar parts, which will be identified with the same reference numerals.

The support frame 10 comprises a base 102 from which extends an upright post 104 that is adapted to support a signal 106 for the railroad 12. Ideally the post 104 will extend vertically from the base 102, but this is not essential and any other upright extension can be used whereby the signal 106 is visibly supported above and adjacent to the railroad 12. Accordingly, although not shown in the drawings, the post 104 can extend at any suitable angle relative to the base 102, such as at any angle between 45° and 90°. Importantly, the post 104 and signal 106 should not impede the movement of a train along the railroad 12 and thus should not protrude into a clearance envelope (space) directly above the railroad 12 that will be traversed by a train.

The post 104 can be provided with more than one signal 106 if needed and can also support different types of signals 106. In the exemplary embodiment, the signal 106 is illustrated as a standard electric signal comprising three discrete lights that can be activated as needed in normal manner.

The base 102 includes two spaced apart elongate beams 108, 110, which are arranged transversely to and project outwardly from the railroad 12. The beams 108, 110 have a length sufficient so that they can traverse both rails 20, 22. Although not essential to the working of the invention, preferably the beams 108, 110 are aligned and joined parallel to each other. The beams 108, 110 can be formed from regular square tubing or I-beams and be joined with several cross-struts for added stability.

It is also envisaged in an alternative embodiment (not shown in the drawings) that the base 102 can comprise only a single sufficiently rigid beam that has a length sufficient to traverse both rails 20, 22.

In use, in order for the base 104 to be secured to the railroad 12, some of the ballast 16 is removed from beneath the rails 20, 22 to form grooves into which the beams 108, 110 can be located. Each of the beams 108, 110 is then connected to the rail base 24 of each of the rails 20, 22 by suitable clamping attachments 112. As shown in FIG. 3, the attachments 112 comprise opposed plates 114 provided on opposite sides of the rail 20 so that the plates 114 extend over the lower flanges 26. The plates 114 are fixed to the beams 108, 110 by bolts 116 to capture the lower flanges 26 between the plates 114 and the beams 108, 110.

In a further embodiment, the attachments 112 can comprise a bracket joined to the beams 108, 110 and extending transversely thereto to thereby permit multiple plates 114 and bolts 116 to clamp each of the beams 108, 110 onto the lower flanges 26. This will enable the base 104 to be a more stably secured to the railroad 12 and restrict loosening of the bolts 116 through vibrations caused by passing trains or inclement weather.

The post 104 extends from an outer extremity 118 of the base 102 remote from the railroad 12. If the base 102 is further elongated, it will be understood that the post 104 can be located intermediate the outer extremity 118 and the railroad 12 so that the signal 106 can be supported at an optimal distance from the railroad 12.

Figure 2:
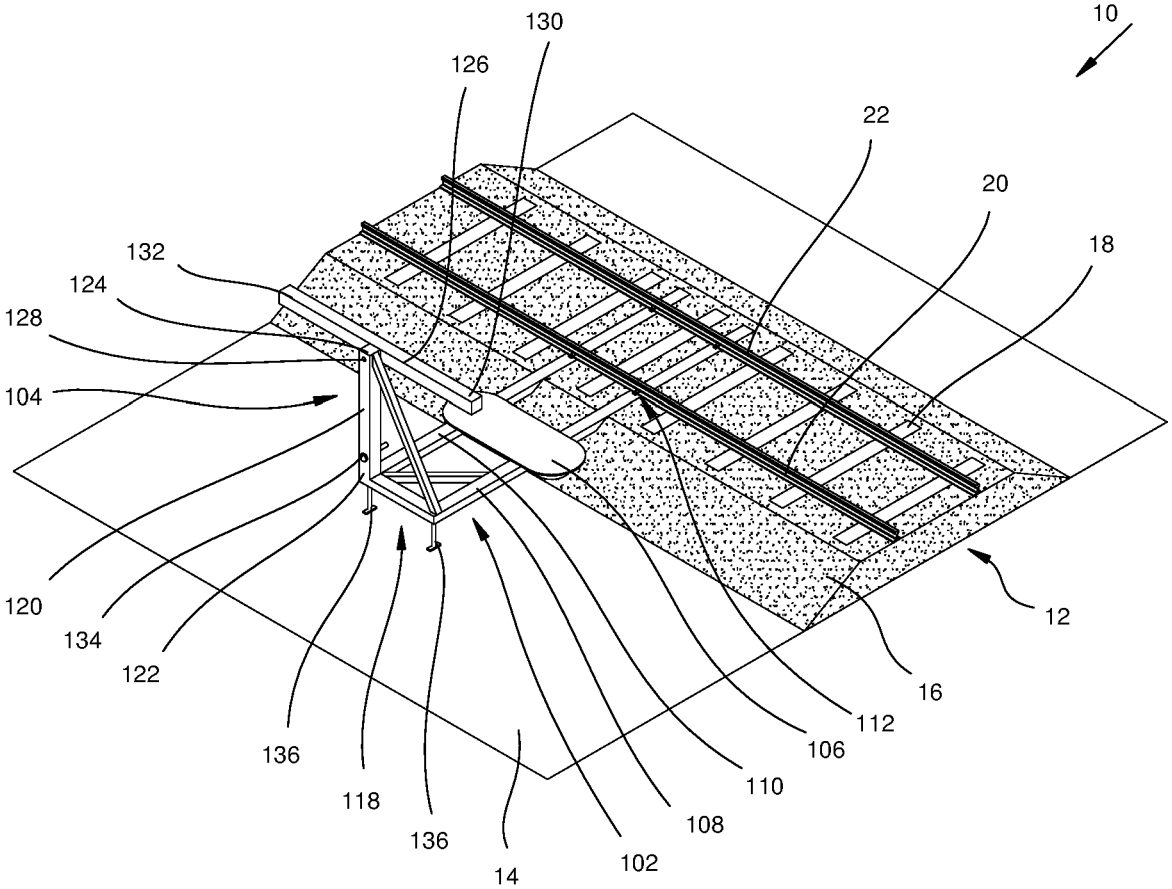
FIG. 2 is a partial perspective view of the support frame of FIG. 1, showing a post of the support frame in a partially collapse state.

As can be more clearly seen in FIG. 2, the post 104 comprises a fixed arm 120 fixedly joined to the base 102 at a fixed end 122 and having a free terminal end 124 remote from the base 102. The post 104 further comprises a movable arm 126 pivotally joined to the fixed arm 120 at pivot 128. The pivot 128 is provided near to the terminal end 124 of the fixed arm 120 and approximately midway along a length of the movable arm 126. Accordingly, the movable arm 126 has a distal end 130 for receiving the signal 106 and an opposed proximal end 132.

The pivot 128 permits the movable arm 126 to be pivoted through a pivot plane between a collapsed position (shown in FIG. 2) and an erected position (shown in FIG. 1). The collapsed position is beneficial for reducing the spatial volume of the support frame 10 to ease the transportation thereof between desired installation locations or for transportation to storage when not needed. In the exemplary embodiment, the pivot plane is orientated substantially parallel to the rails 20, 22. A connecting bolt 134 is used to secure the proximal end 132 of the movable arm 126 to the fixed arm 120 to secure the movable arm 126 in the erected position. More than one connecting bolt 134 may be utilised if needed.

The support frame 10 further comprises one or more feet 136 joined to the base 102 at or near to the outer extremity 118. In the exemplary embodiment, two feet 136 are provided, each foot 136 aligned with a respective beam 108, 110. As will be appreciated, the base 102 projects outwardly from the railroad 12, and the feet 136 can be extended to engage the ground surface 14 to improve the stability of the support frame 10.

If only one foot 136 is provided, ideally it will be longitudinally aligned with the post 104. Further, when multiple feet 136 are provided, at least some of the feet 136 will be aligned with a pivoting plane through which the movable arm 126 pivots so that any change of weight distribution caused during lowering of the post 104 into the collapsed position can be offset and supported by the feet 136.

The feet 136 are extendable or telescopic such that they can be adjusted in length to make allowance for any undulations in the ground surface 14 and also to make allowance for changes in the depth of the track bed and ballast 16 between different railroads 12. It is envisioned that the feet 136 will have the form of scaffolding feet joined to the base 102 by a threaded rod.

Modifications and variations as would be apparent to a skilled addressee are deemed to be within the scope of the present invention.

The invention claimed is:

1. A support frame for a temporary signal for a railroad, wherein the railroad includes a track having two elongate rails, the support frame comprising:

a post arranged to support a railroad signal; and a base joined to the post;

wherein the base comprises a first elongate beam and a second elongate beam spaced from the first elongate beam, the first and second elongate beams for attaching the base to both rails of the track;

wherein each of the first and second elongate beams comprises a respective first longitudinal end and a respective opposite second longitudinal end, the first and second elongate beams connected together at the first longitudinal ends, and the second longitudinal end of each of the first and second elongate beams being free; and wherein the first elongate beam and the second elongate beam are each arranged to be attached to both of the rails.

2. A support frame as claimed in claim 1, wherein the base is arranged to be attached to each of the rails at two or more discrete spaced apart locations.

3. A support frame as claimed in claim 1, wherein the post comprises a fixed arm and a movable arm, and wherein the fixed arm is fixedly joined to the base and the movable arm is pivotally joined to the fixed arm at a pivot.

4. A support frame as claimed in claim 3, wherein the post comprises a connecting bolt for securing the movable arm to the fixed arm so as to prevent pivoting of the movable arm.

5. A support frame as claimed in claim 3, wherein the fixed arm comprises a fixed end joined to the base and an opposed terminal end, and wherein the pivot is provided at or near to the terminal end.

6. A support frame as claimed in claim 3, wherein the movable arm comprises a distal end for receiving the signal and an opposed proximal end, and wherein the pivot is provided substantially centrally along a length of the movable arm between the distal end and the proximal end.

7. A support frame as claimed in claim 6, wherein the proximal end of the movable arm is securable to the fixed arm, thereby to prevent pivoting of the movable arm around the pivot.

8. A support frame as claimed in claim 1, wherein the the first and second elongate beams at least two clamps.

9. A support frame as claimed in claim 1, wherein the support frame comprises at least one foot joined to the base, wherein each foot is positioned so as to be remote from the track during use.

10. A support frame as claimed in claim 9, wherein at least one foot is located so as to be substantially longitudinally aligned with and beneath the post.

11. A support frame as claimed in claim 9, wherein the post comprises a fixed arm and a movable arm, and wherein the fixed arm is fixedly joined to the base and the movable arm is pivotally joined to the fixed arm at a pivot, the support frame comprising multiple feet, wherein the feet are aligned so as to be coplanar with a pivoting plane of the post.

12. A support frame as claimed in claim 9, wherein each foot is extendable or telescopic.

13. A support frame as claimed in claim 12, wherein each foot comprises a scaffolding foot.

14. A temporary signal comprising a support frame as claimed in claim 1, and a railroad signal supported by the post.

15. A method of securing a support frame to a railroad so as to provide a temporary signal for the railroad, wherein the railroad includes a track having two elongate rails, the method comprising the steps of:

providing a post arranged to support a railroad signal, wherein the post is joined to a base having a first elongate beam and a second elongate beam spaced from the first elongate beam for attaching the base to both rails of the track, wherein each of the first and second elongate beams comprises a respective first longitudinal end and a respective opposite second longitudinal end, the first and second elongate beams connected together at the first longitudinal ends, and the second longitudinal end of each of the first and second elongate beams being free; and attaching the first elongate beam and the second elongate beam to both rails of the railroad.

16. A method as claimed in claim 15, comprising attaching the base to each of the rails at two or more discrete spaced apart locations.

17. A method as claimed in claim 15, comprising pivoting the post between a collapsed position intended for use during transportation or storage, and an erected position intended for operative use.

18. A method as claimed in claim 15, comprising supporting a cantilevered end of the base by one or more feet.

* * * * *